United States Patent [19]

Matsuda et al.

[11] 4,123,830

[45] Nov. 7, 1978

[54] SLIDE FASTENER STRINGER

[75] Inventors: Yoshio Matsuda, Nyuzen; Ryuichi Murasaki, Toyama, both of Japan

[73] Assignee: Yoshida Kogyo K.K., Japan

[21] Appl. No.: 826,305

[22] Filed: Aug. 22, 1977

[30] Foreign Application Priority Data

Sep. 2, 1976 [JP] Japan ..... 51-117870[U]

[51] Int. Cl.[2] ..... A44B 19/00

[52] U.S. Cl. ..... 24/205.16 R; 66/195

[58] Field of Search ..... 66/190, 125, 197, 204, 66/195, 192, 193, 194; 24/205.1 C, 205.16 R

[56] References Cited

U.S. PATENT DOCUMENTS 3,939,671 2/1976 Lawson et al. ..... 66/204

FOREIGN PATENT DOCUMENTS 2,546,962 4/1976 Fed. Rep. of Germany ..... 66/195

*Primary Examiner*—Ronald Feldbaum

*Attorney, Agent, or Firm*—Bucknam and Archer

[57] ABSTRACT

A slide fastener stringer includes a reinforcing cord on and along one edge of a stringer tape, the reinforcing cord having a central core and a warp-knit tube surrounding the core and extending longitudinally therewith. The warp-knit tube is made on a circular knitting machine and formed with a plurality of knitting threads having needle loops angularly spaced around the core and sinker loops extending circumferentially across and over the core and between the needle loops. The needle and sinker loops are urged into fastening or clinching engagement with the core.

5 Claims, 15 Drawing Figures

SLIDE FASTENER STRINGER

BACKGROUND OF THE INVENTION

1. Field of the Invention:

The present invention relates to a slide fastener stringer.

2. Prior Art:

Durable functioning of slide fasteners requires that a thickened stringer tape edge be rigid and uniform enough to be firmly gripped by and support stably the attachment legs of coupling elements against displacement on or removal from the tape edge under severe forces. One well known expedient which has been proposed to meet such requirements is stranded yarns mounted on and along a fastener tape edge for supporting coupling elements thereon. However, the stranded yarns are liable to be easily split, crushed, or otherwise deformed when pressed and frequently fail to provide sufficient mechanical strength to stabilize metallic fastener elements staked on or plastic fastener elements injection-molded on the tape edge (FIG. 9). With this prior arrangement, the mounted fastener elements tend to become loose in attachment and irregular in posture during use, resulting in malfunctioning of the slide fastener.

Another element-carrying thickened tape edge comprises a central core surrounded by a weft knit tube. The weft knit tube is subject to radial expansion and cannot fasten the central core radially inwardly. Thus, the tape edge reinforcement is poor in integrity and stability.

SUMMARY OF THE INVENTION

According to the present invention, an element-supporting reinforcing cord on and along a stringer tape edge includes a central core and warp-knitted tube surrounding the central core and extending longitudinally therewith. The warp-knitted tube includes a plurality of knitting threads having needle loops angularly spaced around the central core and sinker loops extending circumferentially across and over the central core and between the needle loops. The needle and sinker loops are urged into fastening engagement with the central core.

It is an object of the present invention to provide a slide fastener stringer including an element-supporting tape edge having increased uniform and rigidity.

Another object of the present invention is to provide a slide fastener stringer including an element-supporting tape edge that is compact in structure and is resistant to longitudinal stretch.

Yet another object of the present invention is to provide a slide fastener stringer including a thickened tape edge on which coupling elements are mounted firmly and stably.

Other objects and advantages of the present invention will become apparent from the following description when taken in conjunction with the accompanying drawings.

DETAILED DESCRIPTION OF THE PREFERRED EMBODIMENTS

Figure 1:
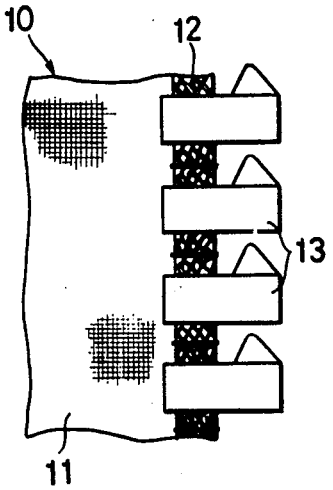
FIG. 1 is a fragmentary plan view of a slide fastener stringer constructed in accordance with the present invention.

FIG. 1 shows a slide fastener stringer 10 comprising a stringer tape 11 made of a woven fabric, for example, a reinforcing cord 12 woven into the tape 11 and located on and along its one edge, and a series of fastener elements 13 mounted on the reinforcing cord 12 at a predetermined interval therealong. The fastener elements 13 are staked on the reinforcing cord 12 where they are made of metal, or injection-molded on the reinforcing cord 12 where they are made of plastic material.

Figure 3:
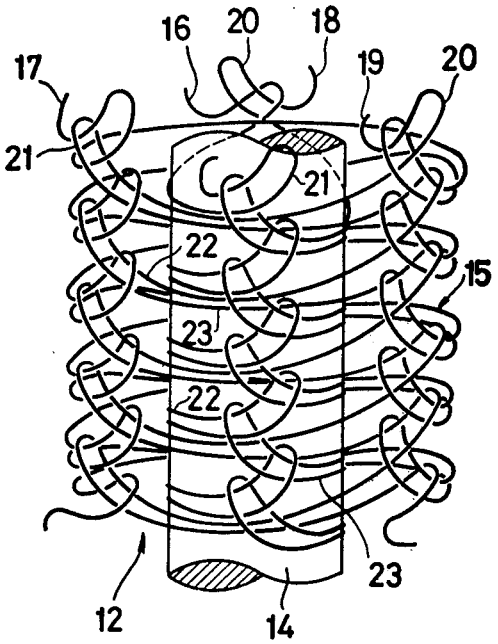
FIG. 3 is an enlarged schematic view showing the loop structure of the reinforcing cord.
Figure 2:
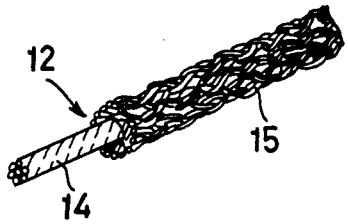
FIG. 2 is a fragmentary perspective view, partly cut away, of a reinforcing cord used as an element-supporting tape edge in the slide fastener stringer shown in FIG. 1.
Figure 4:
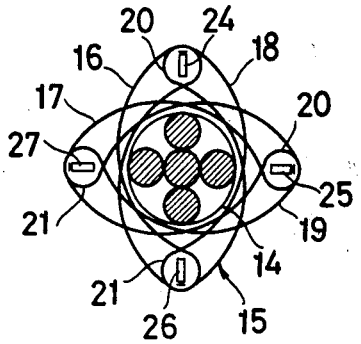
FIG. 4 is a cross-sectional view, with latch needles shown, of the reinforcing cord of FIG. 3.

The reinforcing cord 12 is a thickened construction including a central core 14 made of spun yarn or strands of synthetic fiber, and a warp-knitted tube 15 surrounding the central core 14 and extending longitudinally therewith, as illustrated in FIG. 2. As best shown in FIG. 3, the warp-knitted tube 15 is knitted with four knitting threads 16, 17, 18 and 19 each having a pair of rows of needle loops 20, 21 disposed in diametrically opposed relation and extending longitudinally of the core 14, and pairs of sinker loops 22, 23 extending circumferentially across and over the central core 14 and between the diametrically opposed rows of needle loops 20, 21.

Two out of the four knitting threads 16, 17, 18 and 19 are paired and their needle loops 20, 21 are intermeshed at diametrically opposite sides of the core 14, their sinker loops 22, 23 extending across the core 14 circumferentially along its diametrically opposite sides. The remaining two knitting threads are similarly paired and interlooped, but are arranged in right-angular relationship to the first group of two knitting threads. All of the needle loops 20, 21 and the sinker loops 22, 23 are urged into fastening or clinching relation to the central core 14. Thus, the overall structure of the reinforcing cord 12 is compact and rigid. Further, since the intermeshed needle loops 20, 21 are already stretched warpwise, the warp-knitted tube 15 and hence the reinforcing cord 14 are resistant to longitudinal stretch.

Formation of the warp-knitted tube 15 shown in FIG. 3 will be described with reference to FIG. 4 and FIGS. 5A through 5D. The warp-knitted tube 15 is made on a circular knitting machine having four latch needles 24, 25, 26 and 27 angularly spaced 90° apart from each other with their latches positioned radially outwardly. The latch needles are supported on and extend upwardly from a sleeve block (not shown) that is movable up and down. The circular knitting machine also has a guide disk (not shown) located above and concentrically with the sleeve block, the guide disk being reciprocally rotatable more than 180° about its center. The guide disk has a central hole coaxial with the sleeve block and four apertures angularly spaced 90° apart from each other. The apertures correspond to the latch needles and are disposed radially outwardly of them.

The central core 14 extends through the sleeve block and the central hole in the disk, and the four knitting threads 16, 17, 18, and 19 extend through the apertures in the disk, respectively. While the sleeve block is moved upwardly to bring the latch needles toward the disk, the disk is turned about its center to overlap the needle 24 with the thread 16 (FIG. 5A), the needle 25 with the thread 17 (FIG. 5B), the needle 26 with the thread 18 (FIG. 5C), and the needle 27 with the thread 19 (FIG. 5D). Then, the sleeve block is allowed down as the disk is rotated back. During continued rotation of the disk, the sleeve disk is moved up again to permit the needle 26 to be overlapped by the thread 16 (FIG. 5A), the needle 27 by the thread 17 (FIG. 5B), the needle 24 by the thread 18 (FIG. 5C), and the needle 25 by the thread 19 (FIG. 5D).

Figure 5A:
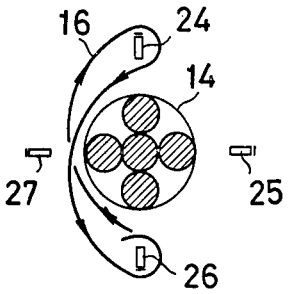
FIGS. 5A through 5D are cross-sectional views each showing the path of supply to a needle of one of the knitting threads for the reinforcing cord shown in FIG. 4.
Figure 5B:
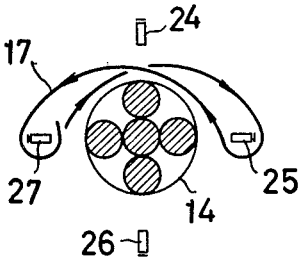
Figure 5C:
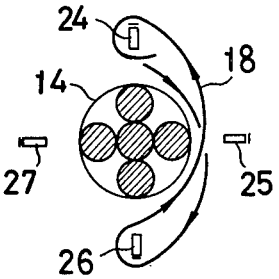
Figure 5D:
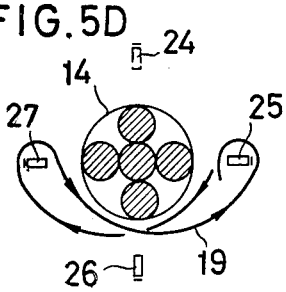

Thus, while the guide disk is reciprocally rotated and the sleeve block is raised and lowered, the knitting threads 16, 18 are supplied to the diametrically opposed or 180° angularly spaced latch needles 24, 26 in the direction of the arrowheads along the paths substantially in the shape of 8 extending at opposite sides of the central core 14 (FIGS. 5A and 5C). Similarly, the diametrically opposed latch needles 25, 27 are supplied with the knitting threads 17, 19 which follow in the direction of the arrowheads the paths substantially in the shape of 8 extending at opposite sides of the central core 14 (FIGS. 5B and 5D). At each latch needle, a needle loop is drawn through a previous needle loop by downward movement of the sleeve block.

Figure 7A:
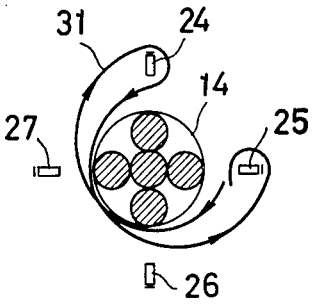
FIGS. 7A through 7D are cross-sectional views each showing the path of supply to a needle of one of the knitting threads for the reinforcing cord shown in FIG. 6.
Figure 7B:
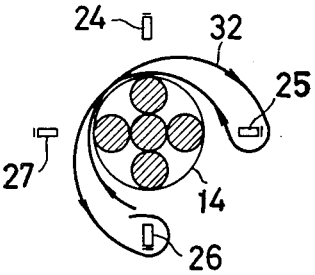
Figure 7C:
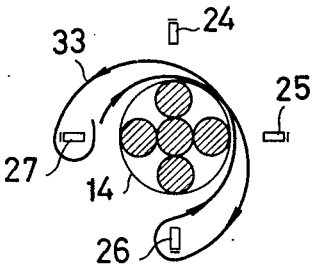
Figure 7D:
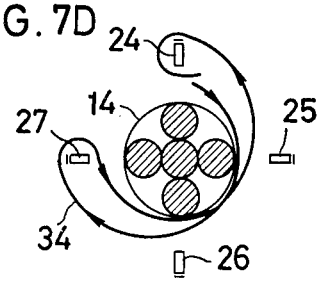
Figure 6:
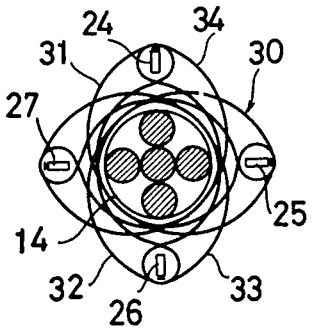
FIG. 6 is a view similar to FIG. 4, illustrating a reinforcing cord according to another embodiment.

According to another embodiment illustrated in FIG. 6, each knitting thread that forms a warp-knit tube 30 is supplied to and overlaps two latch needles that are angularly spaced 270° from each other. More specifically, a knitting thread 31 is fed to the latch needles 24, 25 along a path which extends circumferentially over the central core 14, as shown in FIG. 7A. Similarly, a knitting thread 32 is supplied to the latch needles 25, 26 (FIG. 7B), a knitting thread 33 to the latch needles 26, 27 (FIG. 7C), and a knitting thread 34 to the latch needles 27, 24 (FIG. 7D), all threads having sinker loops extending circumferentially around the central core 14 and between two of the latch needles 24, 25, 26, and 27 which are angularly spaced 270°.

Figure 8:
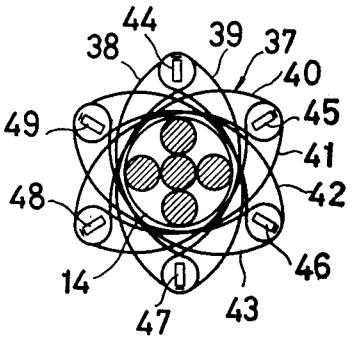
FIG. 8 is a cross-sectional view of still another embodiment of reinforcing cord.
Figure 9:
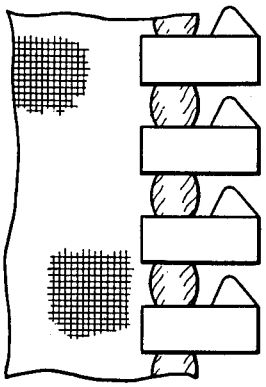
FIG. 9 is a fragmentary plan view of a conventional slide fastener stringer.

FIG. 8 illustrates still another embodiment in which a warp-knitted tube 37 is made up of a total of six knitting threads 38, 39, 40, 41, 42, and 43. The circular knitting machine has six latch needles 44, 45, 46, 47, 48, and 49 angularly spaced 60° apart from each other. Paired ones out of the six knitting threads are supplied to diametrically opposed latch needles. Thus, the latch needles 44, 47 are supplied with the knitting threads 38, 39, the latch needles 45, 48 with the knitting 40, 41, and the latch needles 46, 49 with the knitting threads 42, 43, the threads in each pair extending at opposite sides of and sandwiching the central core 14. The reinforcing cords constructed in accordance with the embodiments of FIGS. 6 and 8 are better in rigidity and tightness than the reinforcing cord 12 shown in FIG. 4.

The reinforcing cords according to the present invention have various advantages in connection with the mounting thereon of fastener elements. Being compact, rigid, and roughened on the surface, the reinforcing cords of the invention provide durable support for metallic or plastic fastener elements. The fastener elements staked, injection-molded, or otherwise mounted are positionally stabilized against pitchwise displacement or accidental removal under severe conditions during use. When metallic fastener elements are to be mounted, their opposed legs need not be spread widely asunder prior to attachment to the reinforcing cords which are relatively slender and tight. Further, the reinforcing cords of the present invention are substantially free from deformation while the fastener elements are being mounted, so that the attachment legs of the elements can grip the cord neatly around without pinching.

An additional advantage is that since the reinforcing cords according to the present invention are prevented from being bulged between the adjacent elements attached, as shown in FIG. 1, element-free space formation in a fastener chain can be accomplished without the danger of damaging the reinforcing cord.

Although preferred specific embodiments have been shown and described, it should be understood that various changes and modifications may be made therein without departing from the scope of the appended claims.

We claim as our invention:

1. A slide fastener stringer comprising a stringer tape having a reinforcing cord on and along its one edge, and a series of fastener elements mounted on and along said reinforcing cord, said reinforcing cord including a central core and a warp-knitted tube surrounding said central core and extending longitudinally therewith, said warp-knitted tube including a plurality of knitting threads each having respective needle loops alternately circumferentially spaced around said central core and sinker loops extending circumferentially across and over a peripheral area of said central core and between said circumferentially spaced needle loops, said needle loops of one of the knitting threads being interlooped with those of another knitting thread, the peripheral areas of said central core on which the sinker loops of said interlooped knitting threads are disposed having respective portions circumferentially oppositely spaced from each other, whereby said needle and sinker loops are urged into fastening engagement with said central core.

2. A slide fastener stringer according to claim 1, said needle loops being angularly spaced 90° apart from each other circumferentially around said central core, and said sinker loops extending between diametrically opposed ones of said needle loops.

3. A slide fastener stringer according to claim 1, said needle loops being angularly spaced 90° apart from each other circumferentially around said central core, and said sinker loops extending between those of said needle loops which are angularly spaced 270°.

4. A slide fastener stringer according to claim 1, said needle loops being angularly spaced 60° apart from each other circumferentially around said central core, and said sinker loops extending between diametrically opposed ones of said needle loops.

5. A slide fastener stringer according to claim 1, said sinker loops extending between said needle loops being substantially in the shape of 8 when said reinforcing cord is viewed cross-sectionally.

* * * * *